US008047154B1

(12) United States Patent
Buescher et al.

(10) Patent No.: US 8,047,154 B1
(45) Date of Patent: Nov. 1, 2011

(54) SYSTEM FOR CHANGING THE ATTITUDE OF LINEAR UNDERWATER SENSOR ARRAYS VIA NEUTRALLY BUOYANT FLUID TRANSFER

(75) Inventors: James Buescher, San Diego, CA (US); V. Keyko McDonald, San Diego, CA (US); Peter Sullivan, Solana Beach, CA (US); Brian J. Granger, San Diego, CA (US); David A. Bultman, San Diego, CA (US); Peter Smith, Raleigh, NC (US); Aaron Bratten, El Cajon, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 233 days.

(21) Appl. No.: 12/506,313

(22) Filed: Jul. 21, 2009

(51) Int. Cl.
*B63G 8/14* (2006.01)

(52) U.S. Cl. ..... 114/330; 114/121

(58) Field of Classification Search ..... 114/125, 114/243, 245, 253, 330, 121, 333; 367/16, 367/18

See application file for complete search history.

(56) References Cited

U.S. PATENT DOCUMENTS

| | | | | |
|---|---|---|---|---|
| 2,887,977 | A | 5/1959 | Piry | |
| 3,343,511 | A * | 9/1967 | Hinton et al. | 114/330 |
| 3,379,156 | A | 4/1968 | Keays | |
| 3,437,065 | A * | 4/1969 | Robbins, Jr. | 114/330 |
| 4,448,145 | A | 5/1984 | Hervieu | |
| 4,745,583 | A * | 5/1988 | Motal | 367/18 |
| 5,144,588 | A * | 9/1992 | Johnston et al. | 367/16 |

* cited by examiner

*Primary Examiner* — Lars A Olson
(74) *Attorney, Agent, or Firm* — Kyle Eppele; Stephen E. Baldwin

(57) ABSTRACT

The attitude of a submerged array of sensing elements can be changed using a fixed quantity of transferable ballast fluid having density different than water. In one embodiment, a non-rigid array of sensor elements is equipped with two expandable reservoirs connected between a flexible conduit which allows the ballast fluid to be transferred back and forth. Pumping fluid between the two reservoirs causes one reservoir to expand while the other contracts. Due to the density difference between the pumped fluid and water, the difference in volume between the two expandable reservoirs causes a shift in the center of buoyancy of the array system. The center of buoyancy in this way becomes offset from the center of gravity of the array system, causing a shift in the attitude of the array. The array can be trimmed, using positively or negatively buoyant static elements, to achieve a specific orientation for given volume ratios between the two expandable reservoirs, and so by controlling the volume ratio, multiple orientations can be selected.

12 Claims, 8 Drawing Sheets

SYSTEM FOR CHANGING THE ATTITUDE OF LINEAR UNDERWATER SENSOR ARRAYS VIA NEUTRALLY BUOYANT FLUID TRANSFER

FEDERALLY-SPONSORED RESEARCH AND DEVELOPMENT

This invention (Navy Case No 99598) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

CROSS-REFERENCE TO RELATED APPLICATIONS

This application is related to pending patent application entitled NEUTRALLY BUOYANT SUBMERGED SYSTEM USING GREATER DENSITY BALLAST FLUID (NC 99596), Ser. No. 12/469,827, filed May 21, 2009, and NEUTRALLY BUOYANT SUBMERGED SYSTEM USING LESSER DENSITY BALLAST FLUID (NC 99597), Ser. No. 12/473,485, filed May 28, 2009, both of which are assigned to the same assignee as the present application, and the details of which are hereby incorporated by reference.

BACKGROUND OF THE INVENTION

Previous methods for modifying the attitude of submerged objects have involved (a) the shifting of non-fluid mass within the submerged object to alter the position of the center of mass, or by (b) dynamic lifting surfaces or thrusters which require relative velocity of the submerging fluid to exert external forces on the object and change its attitude. Alternatively (c) inflatable or floodable volumes may be used to displace or ingest quantities of submerging fluid from a submerged object, thus changing the object's total volume, center of buoyancy, and attitude.

Of the above described previous methods, (a) is impractical for very large or non-rigid submerged objects because of the practical issues of re-positioning non-fluid mass within the object. Further, objects which are not large enough to internally house repositionable masses are limited by that approach. Method (b) is impractical for objects which are or must remain static in the submerged fluid, which is to say those which are not moving or cannot move, and method (c) is impractical for systems which cannot afford an overall change in net buoyancy in order to achieve attitude modification.

SUMMARY

The attitude of a system of submerged array of sensing elements can be changed by using a fixed quantity of transferable ballast fluid having density different than water. In one embodiment, a non-rigid array of sensor elements is equipped with two expandable reservoirs connected by a flexible conduit which allows the ballast fluid to be transferred back and forth. Pumping fluid between the two reservoirs causes one reservoir to expand while the other contracts. Due to the density difference between the pumped fluid and water, the difference in volume between the two expandable reservoirs causes a shift in the center of buoyancy of the array system. The center of buoyancy in this way becomes offset from the center of gravity of the array system, causing a shift in the attitude of the array. The array can be trimmed, using positively or negatively buoyant static elements, to achieve a specific orientation for given volume ratios between the two expandable reservoirs, and so by controlling the volume ratio, multiple orientations can be selected.

BRIEF DESCRIPTION OF THE DRAWINGS

Throughout the several views, like elements are referenced using like references.

DETAILED DESCRIPTION OF THE EMBODIMENTS

The present system provides a means by which the attitude or orientation of a submerged, rigid or non-rigid array of sensing elements can be changed or altered, using primarily a fixed quantity of transferable ballast fluid having density different than water. In one embodiment, a non-rigid array of sensor elements is equipped with two expandable reservoirs, one at each end, and a flexible conduit connected between the two reservoirs allows the ballast fluid to be transferred back and forth. Pumping ballast fluid between the two reservoirs causes one reservoir to expand while the other contracts.

Due to the density difference between the pumped ballast fluid and water, the difference in volume between the two expandable reservoirs causes a shift in the center of buoyancy of the array system. If the center of buoyancy in this way becomes offset from the center of gravity of the array system, this will cause a shift in the orientation of the array. The array can be trimmed, using positively or negatively buoyant static elements, to achieve a specific orientation for given volume ratios between the two expandable reservoirs, and so by controlling the volume ratio, multiple orientations can be selected.

Figure 4:
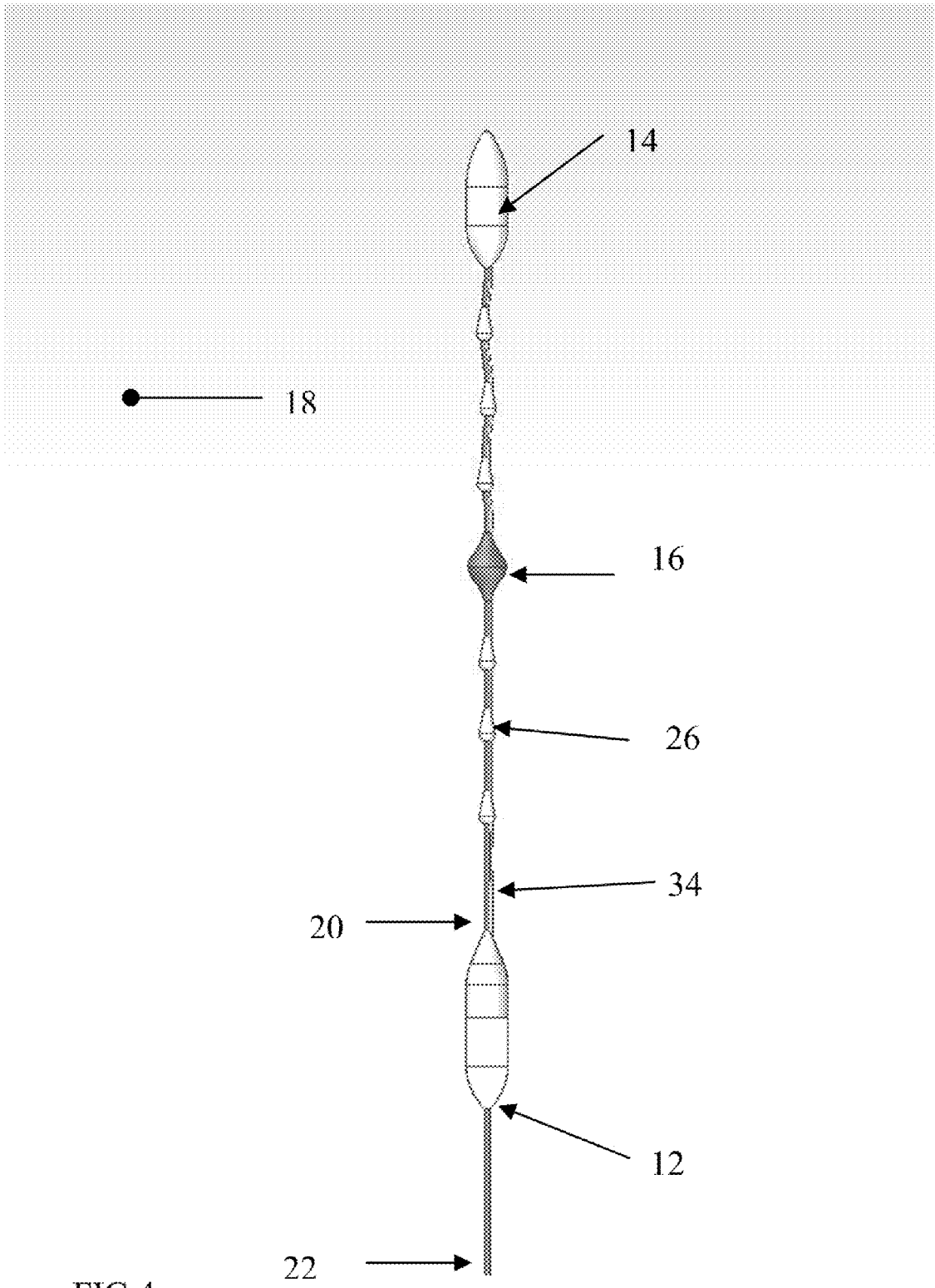
FIG. 4 shows another side view of the present system in which the attitude or orientation has changed.

In one embodiment, the system 10 is an array of sensor elements normally submerged in water and intended to have two separate orientations which may be selected by changing or modifying the attitude of the device through the transfer of a ballast fluid, as previously described. These configurations approximate a horizontal (or level) attitude, as shown in FIG. 1, and a vertical (or upright) attitude as shown in FIG. 4.

Figure 1:
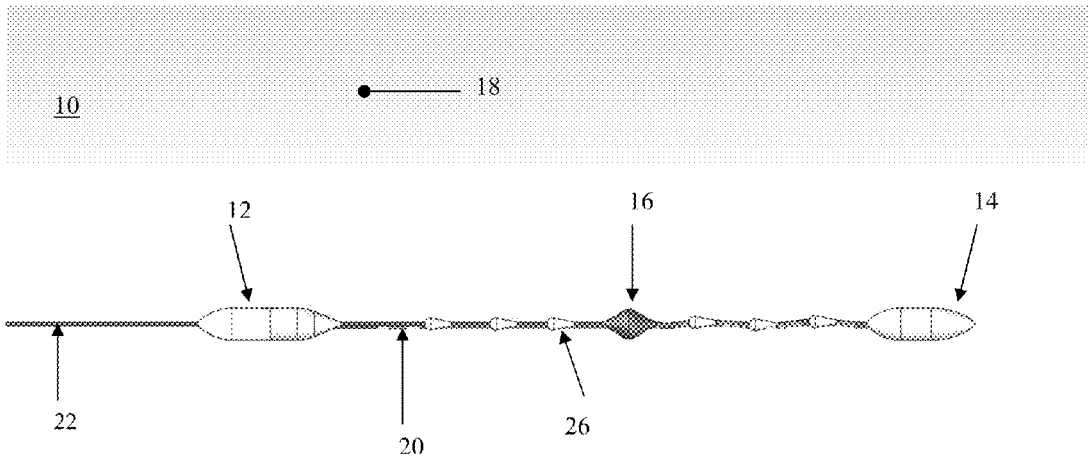
FIG. 1 shows a side view of one attitude or orientation of the present system.

FIG. 1 shows the basic components of a non-rigid array system 10 which is submerged in water 18. The array system 10 includes a flexible cable 20 which can be connected to a data processing and recording system through the forward cable 22. An arbitrary number of sensor elements 16 may be located on the array 10 to collect and transmit information via the cable 20, as well as an arbitrary number of flotation elements 26. System 10 in FIG. 1 also includes a forward ballast system housing 12 and an aft ballast system housing 14.

Figure 2:
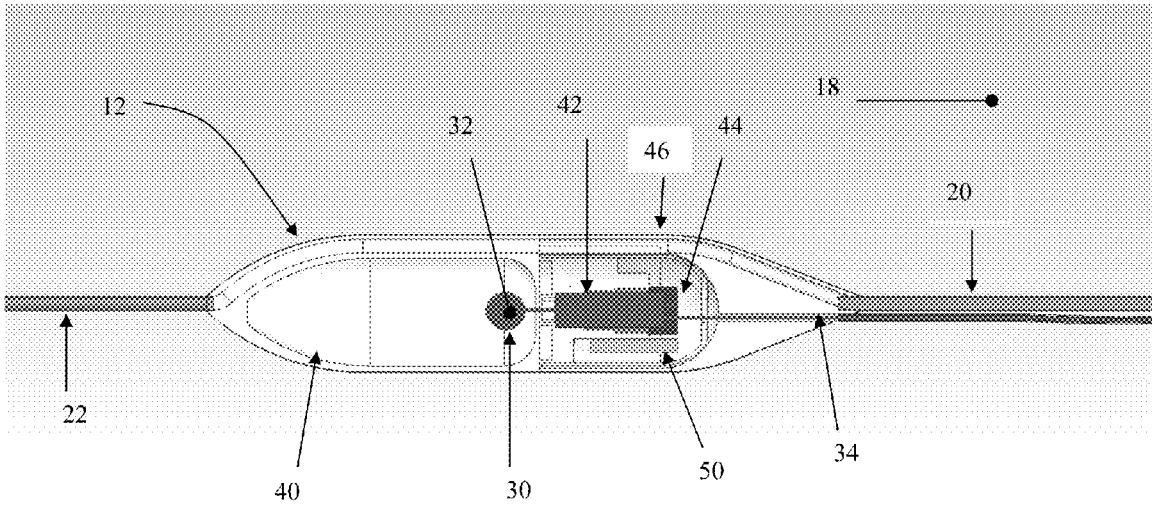
FIG. 2 shows a view of forward ballast housing, which forms a portion of the present system.

While the array 10 is in the horizontal configuration (FIG. 1), the forward ballast system housing 12 is configured as shown in FIG. 2. The forward expandable reservoir 30 contains a residual amount of ballast fluid 32 resulting in a volume lower than the maximum extent imposed by a rigid hollow shell 40. The forward expandable reservoir 30 is connected to a controllable pump mechanism 42 (which could be remotely controlled). The output of the pump 42 is gated by a valve 44 and connected via fluid conduit 34 to the aft ballast system housing 14 of FIG. 1.

In FIG. 2, the pump 42 and valve 44 are controlled by an electrical interface 50. The portion of the streamlined shell 40 which surrounds pump 42, valve 44 and pump control mechanism 42 forms a static trim element 46 integrated into the rigid hollow shell 40. Static trim element 46 offsets the buoyancy of the other components to render this configuration passively stable and neutrally buoyant. Net tension in the forward connecting cable 22 and the array cable 20 is zero.

Figure 3A:
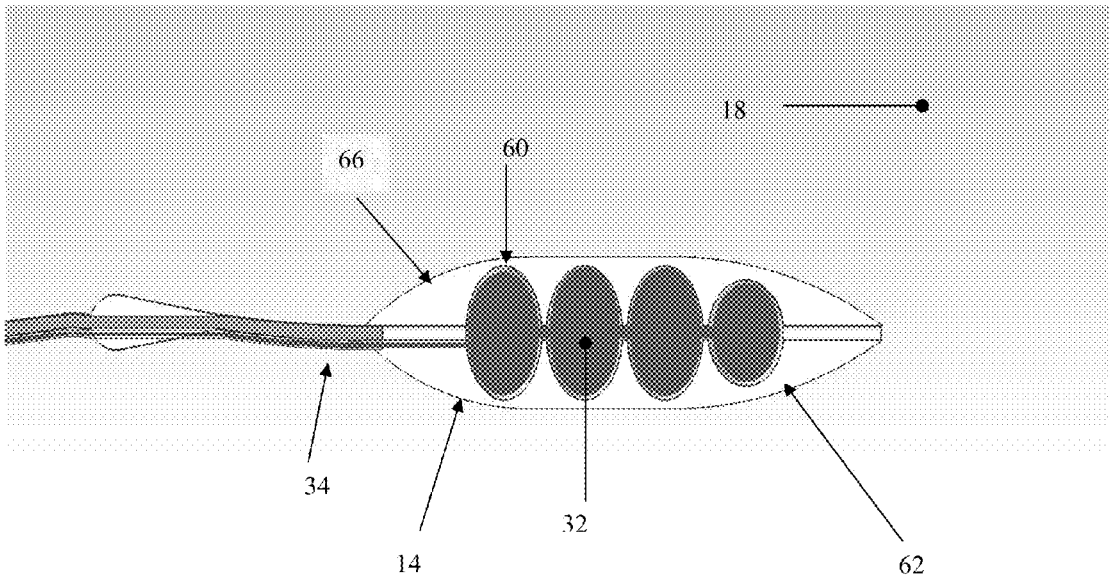
FIGS. 3A and 3B show views of an aft ballast system housing, which forms another portion of the present system.

FIG. 3A shows the condition of the aft ballast system housing 14 while the array 10 is in a horizontal configuration (FIG. 1). In this configuration, the aft expandable reservoir 60, formed by multiple smaller reservoirs, contains a quantity of ballast fluid 32 which has expanded the reservoir to the extent allowed by a rigid hollow shell 62. The reservoir 60 is connected via fluid conduit 34 to the forward ballast system housing 12 of FIG. 1. Backflow of the ballast fluid 32 is prevented by the valve 44 shown in FIG. 2. Static trim element 66, similar to the static trim element 46 of FIG. 2, is integrated into the rigid hollow shell 62 to render this configuration passively stable and neutrally buoyant.

Figure 3B:
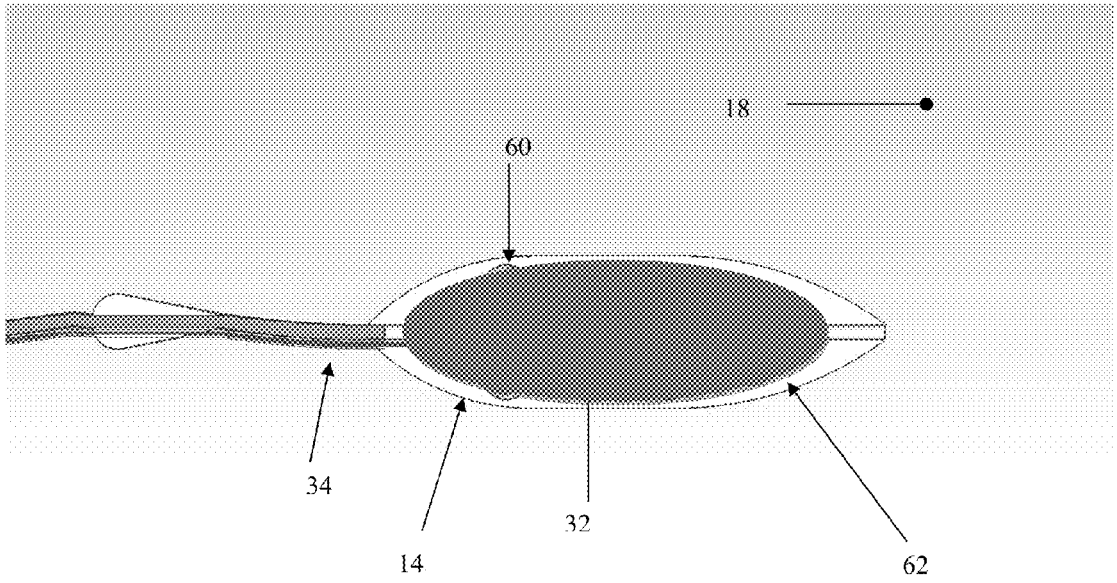

FIG. 3B shows a view of the aft ballast system housing 14 with a single, expandable reservoir 60, which could also be utilized with the system 10.

Reservoirs 30, 60 are typically an elastomeric (rubber) type material which can be suitably expanded. One type of reservoir which could be utilized with the system 10 of FIG. 1 is an elastomeric rolling diaphragm from Bellofram Corporation. The flexible conduit 34 could be a flexible polyurethane hose, known as Tygon tubing.

In some applications, the ballast fluid 32 could be Fluorinert, a liquid greater in density than the surrounding fluid 18, which in this instance is water. Fluorinert is available from 3M Company. In other applications, the ballast fluid 32 could be an oil-based fluid which is lesser in density than water.

Figure 5:
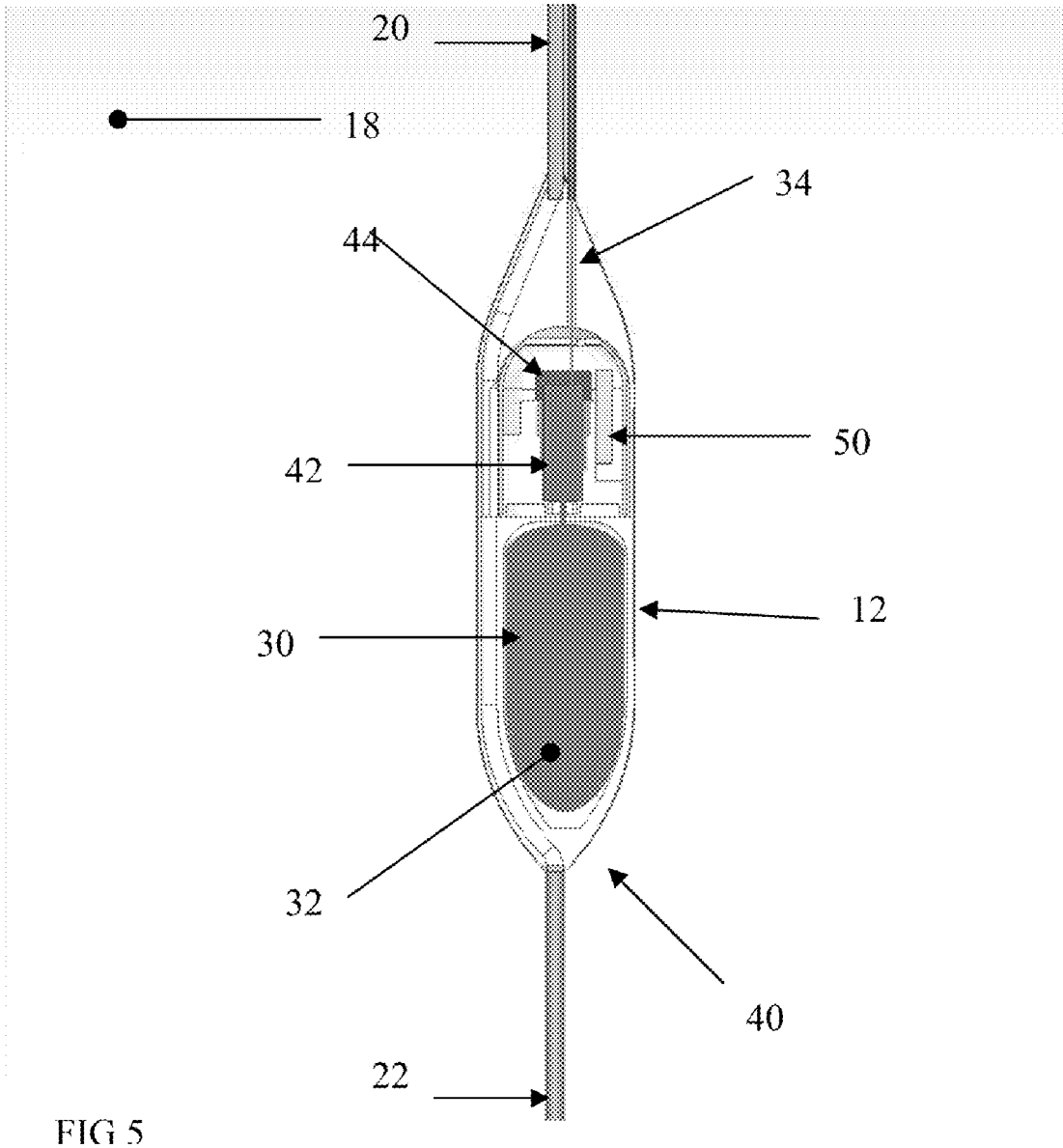
FIG. 5 shows another view of the forward ballast housing.

FIGS. 4-6 show the array system 10 in its alternate (vertical) configuration. FIG. 4 shows the orientation of the array 10 after it has been modified to achieve vertical attitude. Notably, the aft ballast system housing 14 has been shifted by a net gain in positive buoyancy to a position above the forward ballast system housing. The forward ballast system housing has been shifted by a net loss of buoyancy to a position below the aft ballast system housing. The net change in system buoyancy is zero, and the net tension in array cable 20 is non-zero. The net tension in the forward connecting cable 22 remains zero.

FIG. 5 shows the forward ballast system housing when the array 10 has been configured for vertical orientation. The electronic controller 50 has opened the valve 44 and activated the pump 42, causing ballast fluid 32 to flow into the forward expandable reservoir 30. Ballast fluid 32 is allowed to flow until the reservoir 30 has expanded to the limit imposed by the rigid hollow shell 40. In one embodiment, completion of the fluid transfer cycle is detected by monitoring the current drawn by the pump 42. When the reservoir 30 can no longer expand, pressure rising inside the reservoir 30 causes an increase in pump current which is detected by the controller 50, causing the pump 42 switch off and the valve 44 to close. As previously described, static trim elements integrated into the rigid hollow shell 40 render this configuration passively stable and negatively buoyant. Net tension in the forward connecting cable 22 is zero; however net tension in the array cable 20 is non-zero.

Figure 6A:
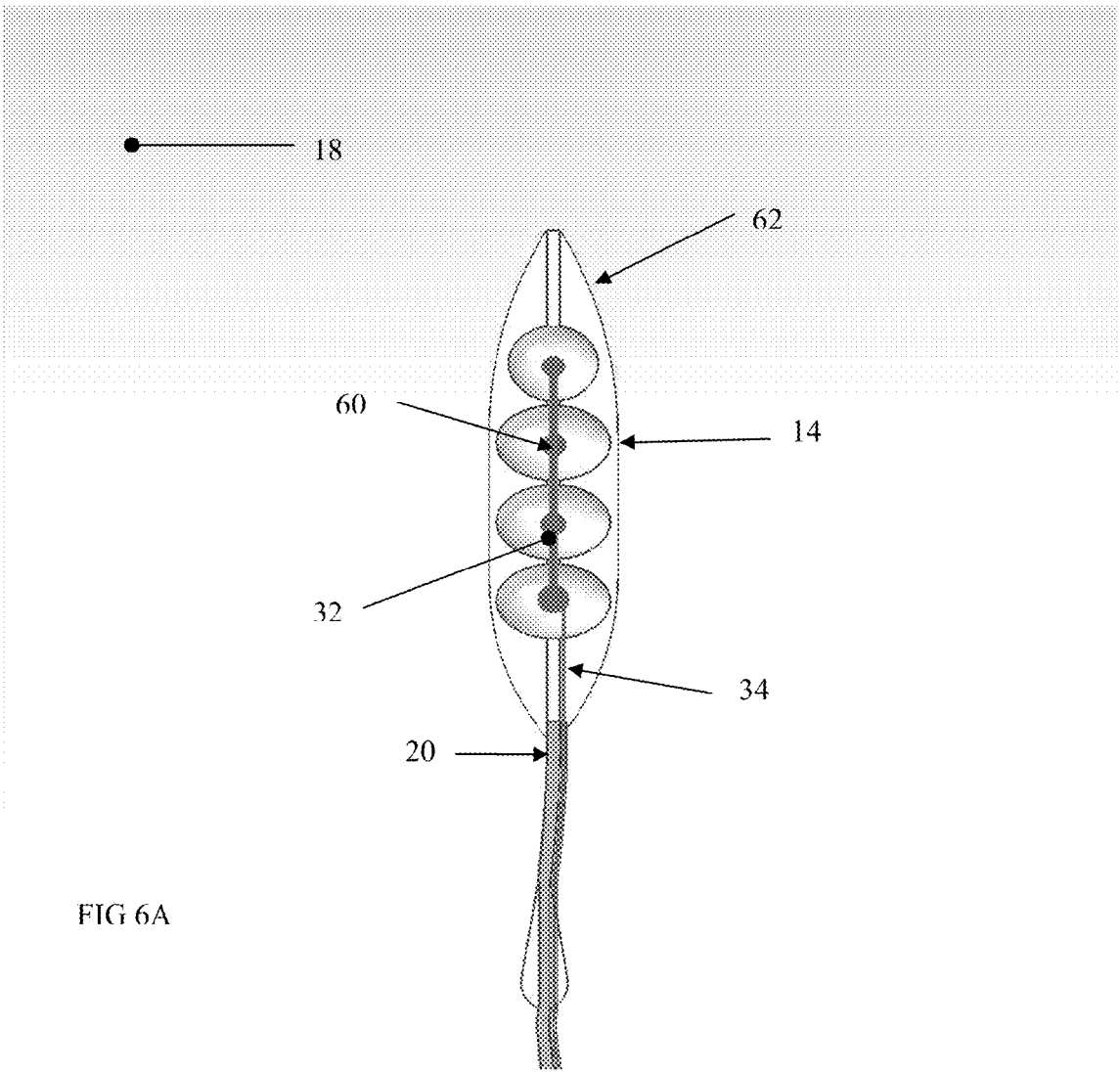
FIGS. 6A and 6B show other views of the aft ballast housing.

FIG. 6A shows the aft ballast system housing 14 when the array 10 has been configured for vertical orientation. Notably the expandable reservoir 60, which includes multiple smaller reservoirs, has been largely drained by the transfer of ballast fluid 32 to the forward expandable reservoir 30 (FIG. 2), and now contains only a residual amount of ballast fluid 32. As previously described, static trim elements integrated into the rigid hollow shell 62 render this configuration passively stable and positively buoyant. Net tension in the array cable (20) is non-zero.

Figure 6B:
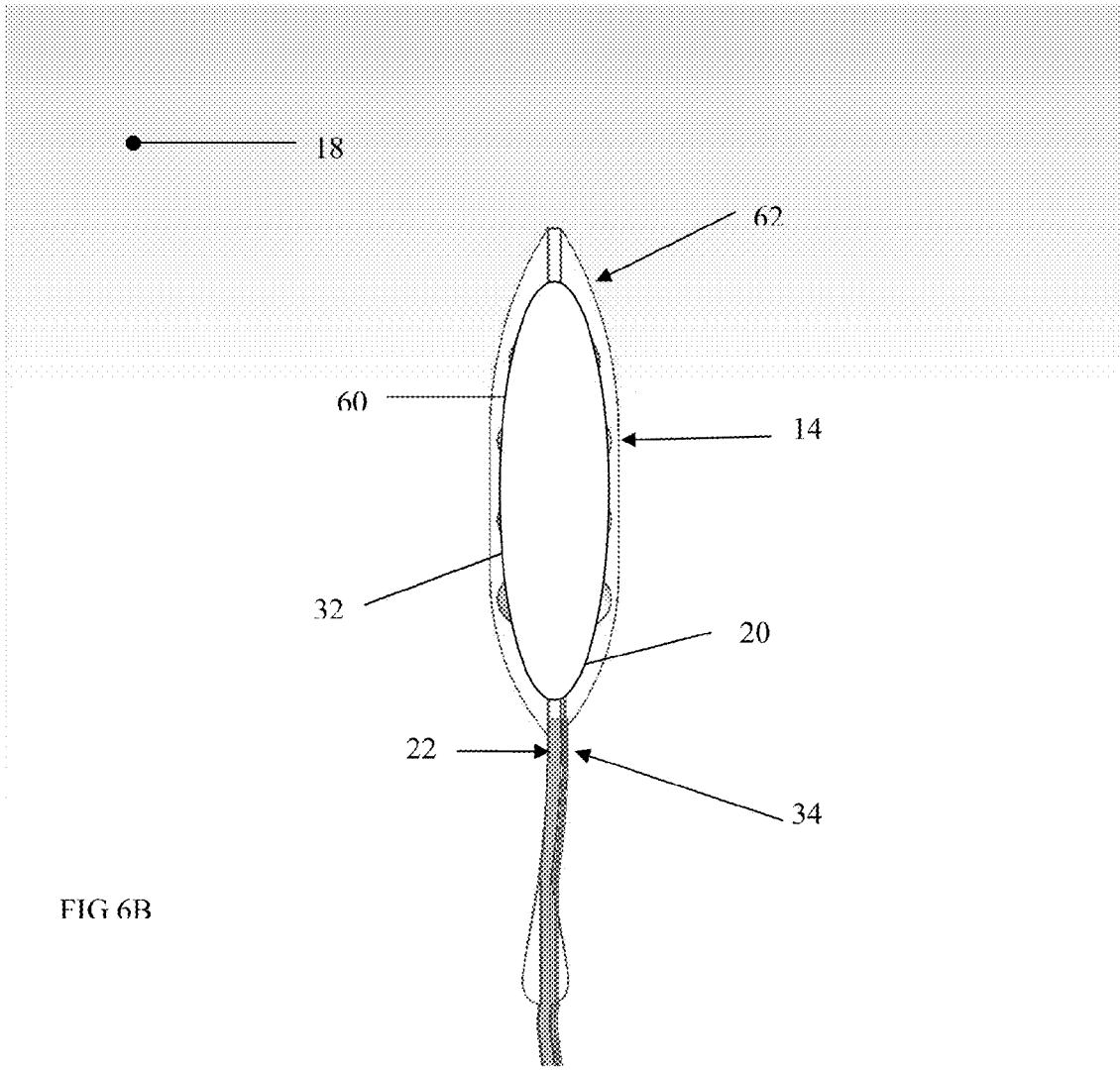

FIG. 6B shows the aft ballast system housing 14, with a single expandable reservoir 60, analogous to FIG. 3B, and which also could be utilized with the system 10.

The process is reversible, and by reversing the pump and returning fluid to the configuration shown in FIGS. 1-3, the array 10 can be again made passively stable in a horizontal configuration. In one embodiment, tension in the forward connecting cable 22, due to motion of the system 10 through the water, aids in reverting the array to a horizontal configuration.

Regarding the static trim elements, for the case where negatively buoyant ballast fluid is used, the static trim elements can be made from a buoyant polyurethane foam material, trade named "Last-a-Foam", which is manufactured by General Plastics Manufacturing Co in Tacoma, Wash. For cases where a positively buoyant ballast fluid is used, the static trim elements could be made of plastic which is heavier than water. Delrin is the trade name of one material which could be used, PVC is another. The trim elements could also be made of Last-a-Foam impregnated with lead shot. All of these materials could be used to provide negatively buoyant trim elements.

The method described by this invention has the advantage of working to change the attitude of non-rigid submerged arrays. The invention works to change attitude of a submerged array even when the array is completely static. The invention does not cause any net negative or positive buoyancy gain in the array. The transfer of a ballast fluid between the reservoirs is controlled by pump mechanism, as previously described. An arbitrary number of sensor elements may be located on the array to collect and transmit information via a separate cable, as well as an arbitrary number of flotation elements. The system 10 can be applied to sensor arrays such as a DADS (Deployable Autonomous Distributed System) array, as well as other objects, such as a rigid beam or the hull of a submarine, as examples.

The method described by this invention has the advantage of working for rigid as well as non-rigid submerged bodies, so long as the expandable reservoirs can be connected by flexible conduit. System 10 transfers fluids of different density than the surrounding fluid to change the center of mass, center of buoyancy, and attitude of submerged objects. The system 10 works to change the attitude of a submerged object even when the object is completely static in the submerging fluid. The invention can be applied externally to pre-existing submerged objects which may be of small or unusual shape, or unsuitable for internal modification. The invention does not cause any net negative or positive gain in total buoyancy of the array or attached systems.

From the above description of the system 10 for changing the attitude of linear underwater sensor arrays via neutrally buoyant fluid transfer, it is apparent that various techniques may be used for implementing the concepts of system 10 without departing from its scope. The described embodiments are to be considered in all respects as illustrative and not restrictive. It should also be understood that system 10 is not limited to the particular embodiments described herein, but is capable of many embodiments without departing from the scope of the claims.

What is claimed is:

1. An array system including a sensor array submerged in surrounding water comprising a first ballast housing;

a second, separate ballast housing;

the first and second housing connected via a flexible connector cable;

one or more sensor elements connected between the first and second housing for collecting and transmitting information via the flexible cable;

the first ballast housing including a first rigid outer shell and a first expandable reservoir containing a residual amount of a ballast fluid, different in density than the surrounding water, resulting in a volume lower than a maximum extent imposed by the rigid outer shell;

the second ballast housing including a second rigid hollow shell and a second expandable reservoir containing a quantity of the ballast fluid expanded into the second reservoir to the extent allowed by the second rigid hollow shell, a controllable pump mechanism for controlling transfers of the ballast fluid between the first and second ballast housings via a fluid conduit to change the center of mass, center of buoyancy or attitude of the submerged sensor array without altering the net buoyancy of the system while not causing any net negative or positive gain in total buoyancy of the array system.

2. The system as in claim 1 comprising a remotely controlled pump mechanism.

3. The system as in claim 1 wherein the sensor array is resilient.

4. The system as in claim 1 wherein the sensor array is rigid.

5. The system as in claim 1 comprising buoyant static elements for achieving a specific attitude.

6. The system as in claim 5 comprising positive buoyant static elements.

7. The system as in claim 5 comprising negative buoyant static elements.

8. The system as in claim 1 wherein the ballast fluid is greater in density than water.

9. The system as in claim 1 wherein the ballast fluid is lesser in density than water.

10. The system as in claim 1 wherein the pump mechanism prevents backflow of the ballast fluid.

11. An array system including a sensor array submerged in surrounding water comprising a first ballast housing;

a second, separate ballast housing;

the first and second housing connected via a flexible connector cable;

one or more sensor elements connected between the first and second housing for collecting and transmitting information via the flexible cable;

the first ballast housing including a first rigid outer shell and a first expandable reservoir containing a residual amount of a ballast fluid, different in density than the surrounding water, resulting in a volume lower than a maximum extent imposed by the rigid outer shell;

the second ballast housing including a second rigid hollow shell and a second expandable reservoir containing a quantity of the ballast fluid expanded into the second reservoir to the extent allowed by the second rigid hollow shell, a controllable pump mechanism for controlling transfers of the ballast fluid between the first and second ballast housings via a fluid conduit to change the center of mass, center of buoyancy or attitude of the submerged sensor array without altering the net buoyancy of the system.

12. An array system including a sensor array submerged in a surrounding fluid comprising a first ballast housing;

a second, separate ballast housing;

the first and second housing connected via a flexible connector cable;

one or more sensor elements connected between the first and second housing for collecting and transmitting information via the flexible cable;

the first ballast housing including a first rigid outer shell and a first expandable reservoir containing a residual amount of a ballast fluid, different in density than the surrounding fluid, resulting in a volume lower than a maximum extent imposed by the rigid outer shell;

the second ballast housing including a second rigid hollow shell and a second expandable reservoir containing a quantity of the ballast fluid expanded into the second reservoir to the extent allowed by the second rigid hollow shell, a controllable pump mechanism for controlling transfers of the ballast fluid between the first and second ballast housings via a fluid conduit to change the center of mass, center of buoyancy or attitude of the submerged sensor array between horizontal and vertical attitudes without altering the net buoyancy of the system while not causing any net negative or positive gain in total buoyancy of the array system.

* * * * *